United States Patent [19]

Dibble et al.

[11] Patent Number: 4,804,338

[45] Date of Patent: Feb. 14, 1989

[54] BACKSHELL ASSEMBLY AND METHOD

[75] Inventors: Gary L. Dibble, Canaoga Park; James H. Reynolds; Susan L. Stene, both of Santa Clara, all of Calif.

[73] Assignee: Sigmaform Corporation, Santa Clara, Calif.

[21] Appl. No.: 28,491

[22] Filed: Mar. 20, 1987

[51] Int. Cl.[4] ..... H01R 13/648

[52] U.S. Cl. ..... 439/583; 29/859; 439/610; 439/932

[58] Field of Search ..... 439/932, 274, 279, 523, 439/583–584, 610; 29/828, 857, 859, 877, 878, 893; 174/DIG. 8

[56] References Cited

U.S. PATENT DOCUMENTS

| | | | |
|---|---|---|---|
| 3,035,113 | 5/1962 | Danchuk | 339/DIG. 1 |
| 3,074,045 | 1/1963 | Overholser | 339/177 R |
| 3,110,756 | 11/1963 | Genung et al. | 339/177 R |
| 3,171,707 | 3/1965 | Powell | 339/177 R |
| 3,193,792 | 7/1965 | Shea, Jr. | 339/DIG. 1 |
| 3,413,407 | 11/1968 | Potter | 339/177 R |
| 3,514,741 | 5/1970 | Noren | 339/177 R |
| 3,550,064 | 12/1970 | Caller et al. | 439/583 |
| 3,582,868 | 6/1971 | Trimble et al. | 439/523 |
| 3,601,783 | 8/1971 | Loose | 439/932 |
| 3,851,296 | 11/1974 | Muchmore et al. | 339/DIG. 1 |
| 3,990,661 | 11/1976 | De Groef | 248/56 |
| 3,990,765 | 11/1976 | Hill | 439/932 |
| 4,135,776 | 1/1979 | Ailawadhi et al. | 439/583 |
| 4,255,011 | 3/1981 | Davis et al. | 339/177 R |
| 4,306,760 | 12/1981 | Testa | 339/103 M |
| 4,431,254 | 2/1984 | Cartesse | 339/177 R |
| 4,450,871 | 5/1984 | Sato et al. | 174/DIG. 8 |
| 4,681,985 | 7/1987 | Katz et al. | 174/73 R |

FOREIGN PATENT DOCUMENTS

| | | | |
|---|---|---|---|
| 2316053 | 10/1973 | Fed. Rep. of Germany | 439/932 |
| 1046811 | 10/1983 | U.S.S.R. | 439/932 |

OTHER PUBLICATIONS

Military Specification Sheet MIL-C-85049/68, 1-1-6-80.

Military Specification Sheet MIK-C-85049/60, 1-1-6-80.

Catalog #L-79C, American Pamcor, Inc. 2-1970 (174, DIG. 8).

*Primary Examiner*—John McQuade

*Attorney, Agent, or Firm*—Limbach, Limbach & Sutton

[57] ABSTRACT

A backshell assembly and method of making and assembling a connection between electrical cable and another electrical device are disclosed. The backshell assembly includes a hollow cylindrical body having a first end for attachment to the other electrical device. A hollow cylindrical nut is provided for attachment to the other end of the backshell body and for entrance of the cable. A hollow cylindrical heat shrinkable tube is provided with its central portion shrunk down and bonded to the nut and with end extensions stress relieved by being heat shrunk and provided with an inside diameter greater than the diameter of the outside surface of the nut.

16 Claims, 2 Drawing Sheets

BACKSHELL ASSEMBLY AND METHOD

The present invention relates in general to backshells for connecting an electrical cable to another electrical device and the method of making and assembling the assembly and the connection.

BACKGROUND OF INVENTION

Various backshell structures are known for making a mechanical connection at the end of a cable and typically where a grounding connection is required such as with metal sheath cable and coaxial cable.

The desired features for a backshell for connection and grounding of electrical cables are EM and RF shielding, abrasion protection, strain relief, and an environmental seal. The prior art devices have suffered in one way or another in providing the desired features in a simple easy to assemble and apply structure.

BRIEF SUMMARY OF THE INVENTION

The object of the present invention is the provision of a backshell assembly and method of making and assembling the same which results in desired shielding, abrasion protection, strain relief and an environmental seal.

Broadly stated, the present invention, to be described in greater detail below, is directed to a backshell assembly and method of making and assembling same for connecting an electrical cable to other electrical devices and comprising a hollow cylindrical body member having a first end for engagement with the other electrical device and a second end for engagement with the electrical cable, a hollow cylindrical nut having an outside surface, a first end for attaching to the second end of the connector member and a second end and a hollow cylindrical, heat shrinkable tube surrounding and bonded to the outside surface of the nut and extending axially beyond both ends of the nut whereby the body member and nut can be attached together and to the cable and the other device and then the tube extensions can be shrunk down onto the body member and the cable.

One feature and advantage of the present invention is the provision of a simple, easy to assemble backshell structure which provides good mechanical integrity from the cable to the other electrical device and which at the same time provides shielding, a stress relieved connection and an environmental seal.

Another feature and advantage of the present invention is a backshell assembly such that the tubing, upon heat shrinking, will not tend to slide longitudinally or "milk off" from the other backshell structure.

In accordance with another aspect of the present invention, the axial extensions of the tube beyond the ends of the nut have a layer of sealant on the inside surface thereof and have an inside diameter greater than the diameter of the outside surface of the nut.

A feature and advantage of this aspect of the present invention is that the body member and the cable can be inserted into the extensions of the tube when the backshell is being mechanically assembled and sufficient heat will have to be applied to the tube extensions to soften the sealant before the tube shrinks onto the cable and the backshell body.

In accordance with another aspect of the present invention, the inside diameter of the tube extensions is at least 1.08 times the outside diameter of the body member.

In accordance with another aspect of the present invention, the tube extensions have been stress relieved by being heat shrunk from a larger diameter when the central portion of the tube was heat shrunk onto the nut to prevent any longitudinal movement during subsequent heat shrinking. Upon subsequent heat shrinking onto the cable and the body member, the tube extensions will then have their ends at the desired locations on the body and the cable as a result of this stress relieving.

In accordance with still another aspect of the present invention, the outside surface of the body has a diameter the same as or less than the diameter of the outside surface of the nut.

In accordance with the last aforementioned aspect of the present invention, the body member having a diameter less than the outside diameter of the nut provides a backshell wherein the tube is captured lengthwise by the nut and will not "milk off" from the nut. The extensions provide an environmental seal from the exterior surface of the cable to the exterior surface of the body.

In accordance with still another aspect of the present invention, the backshell includes a spin coupling member for connecting the backshell to the other electrical devices and one end of the tube extends over the spin coupling so that the environmental seal is created from the surface of the cable to and including the spin coupling.

These and other aspects, features and advantages of the present invention will be more appreciated upon a perusal of the following specification and the accompanying drawing wherein similar characters of reference referred to similar elements in each of the separate views.

DESCRIPTION OF THE PREFERRED EMBODIMENT

Figure 1:
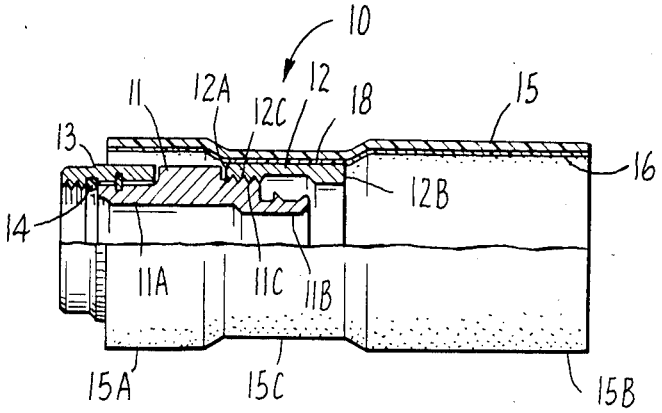
FIG. 1 is an elevational, partial cross-sectional view of one backshell assembly in accordance with the present invention.

With reference to FIG. 1, there is shown a side elevational view, partially in section, of a backshell assembly 10 in accordance with the preferred embodiment of the present invention ready for attachment to an electrical cable (not shown) at the right side of the backshell assembly 10 and to another electrical device (not shown) at the left side of the backshell assembly 10. The backshell assembly 10 includes a hollow cylindrical backshell body member 11 having a first end 11A for engagement with the other electrical device and a second end 11B for entrance of the electrical cable and attachment to the metal, cable braid. A hollow cylindrical nut 12 has a first end 12A for removable attachment to the body member 11, such as via the illustrated threads 11C and 12C and has a second end 12B.

In the specific illustrated physical configuration of the backshell elements the second end 11B of the body member 11 has a reduced diameter from the inside surface of the nut 12. This construction enables attachment of the metal shield of the cable at the body reduced diameter portion such as by a clamping band B (See FIG. 2).

In the embodiment illustrated in FIG. 1, a spin coupling element 13 is included on the first end 11A of the body member 11 for making the engagement or physical attachment of the backshell assembly 10 to the electrical device. A connector sealing O-ring 14 is provided at the first end of the body member, and in the embodiment of FIG. 1 is captured within a annular recess on the inside surface of the spin coupling member 13.

A hollow heat shrinkable tube or boot 15 is provided surrounding the nut 12. The tubing has first and second extensions or end portions 15A and 15B extending beyond the first and second nut ends 12A and 12B, respectively, around the body 11 and the cable that will be connected via this backshell assembly 10. The central or medium portion 15C of the tube 15 has been shrunk down and bonded with an appropriate bonding material 18 such as one of the quick setting adhesives. Examples of these adhesives are the lower (such as methyl or ethyl) alkylcyanoacrylate type adhesives. An appropriate commercially available adhesive is Loctite 495. Upon assembly of the nut 12 and body 11, the nut precisely locates the tubing 15 with respect to the body 11 and the cable and shields the attachment of the metal, cable braid or shield to the body 11.

The tube extensions 15A and 15B, which have also been shrunk down to their illustrated shape as will be described in greater detail below with reference to FIGS. 12A–12D, have an inside diameter greater than the diameter of the outside surface of the nut 12 and with the tubing bevelled in a smooth transition from the larger diameter end extensions to the smaller diameter median portion. A sealant material 16 such as a hot melt adhesive is provided on the inside surface of the end extensions 15A and 15B for creating a waterproof seal between the tubing 15, the backshell body 11, the coupling member 13 and the electrical cable when the backshell assembly 10 is installed.

The heat shrinkable tube 15 is made of a thermoplastic polymer such as polyolefin which has been chemically or radiation cross-linked or which inherently possesses the property of heat recoverability. The tube or boot 15 is made from medium to thick wall tubing which has a shrink ratio of at least 3 to 1. With such a shrink ratio a backshell assembly of one specific size of body 11 and nut 12 can be utilized with cables of various different diameters and still provide the desired environmental seal and required strain relief.

Figure 2:
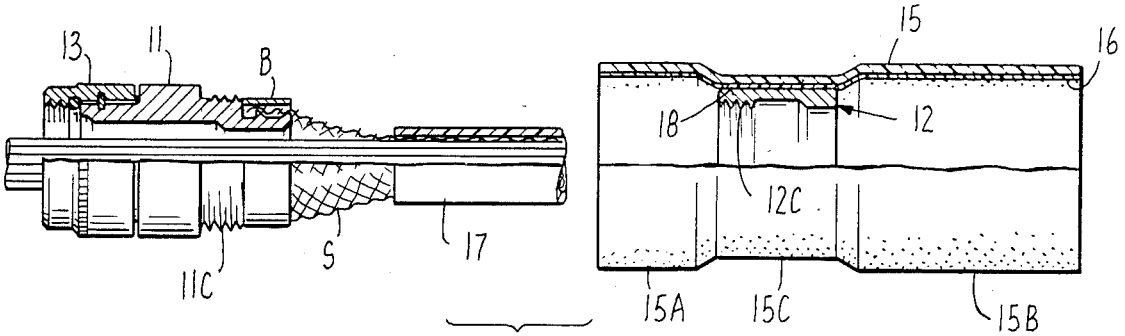
FIG. 2 is an elevational, partial cross-sectional view of a backshell assembly of this invention with the backshell body attached to the metal braid of a cable and ready for attachment of the bonded tube and nut to the body.

FIG. 2 illustrates the attachment of the body member 11 to the metal shield S of a cable 17 which has had its outer insulation layers removed part way back and its conductors passed through the body for appropriate usage at the other electrical device(not shown). The cable shield S has been attached to the reduced diameter portion of the body second end 11B by a clamping band B ready for sliding the nut 12 and tubing 15 in place for attachment to the body 11.

Figure 3:
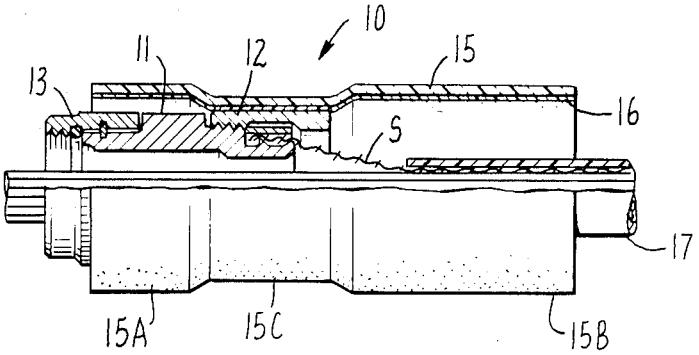
FIG. 3 is a view similar to FIG. 2 with the nut and bonded tube threaded fully up onto the body of the backshell assembly ready for heat shrinking the tube of the backshell assembly.

FIG. 3 illustrates the nut 12 and bonded tube 15 threaded onto the backshell body 11. The backshell assembly 10 in this configuration is ready to have the tube 15 shrunk down by heat applied typically beginning at one end of the tube 15 and gradually applied lengthwise of the tube 15. The enlarged diameter end extensions 15A and 15B are such that the sealant 16 will have softened by the time sufficient heat has been applied to the tube 15 to cause it to shrink down onto the cable C and the body member 11.

Figure 4:
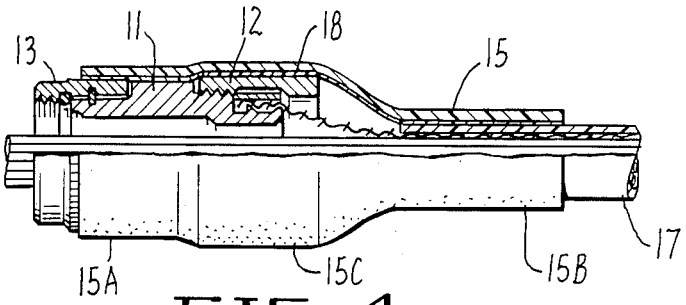
FIG. 4 is a view similar to FIG. 3 after the tube of the assembly has been heat shrunk.

FIG. 4 illustrates the completed backshell assembly after the end extension 15A has shrunk down onto the body member 11 and coupling nut 13 and the end extension 15B has shrunk down onto the cable C.

Referring now to FIGS. 5–11, there are illustrated alternative embodiments of the present invention. The backshell assemblies in these embodiments utilize tubing shorter at its first end than that in the embodiment of FIGS. 1–4 so that the tubing shrinks down only on the backshell body and does not capture the spin coupling nut 13 as well.

Figure 5:
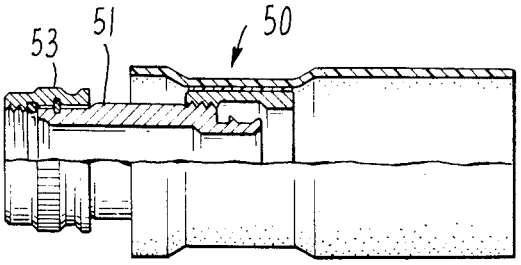
FIGS. 5–11 are views similar to FIG. 1 showing alternative embodiments of the present invention.

In the embodiment of FIG. 5 the body 51 has a spin coupling 53. The first end extension 55A of the tube 55 shrinks down onto the body 51 but not onto the spin coupling 53.

Figure 6:
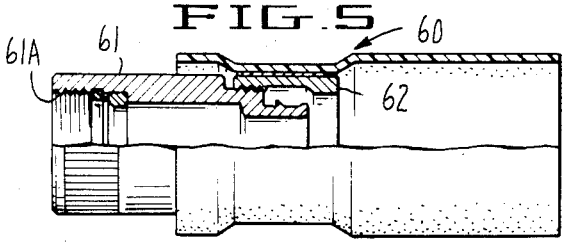

The backshell assembly 60 shown in FIG. 6 employs a body member 61 with a straight threaded connection at its first end 61A instead of a spin coupling.

Figure 7:
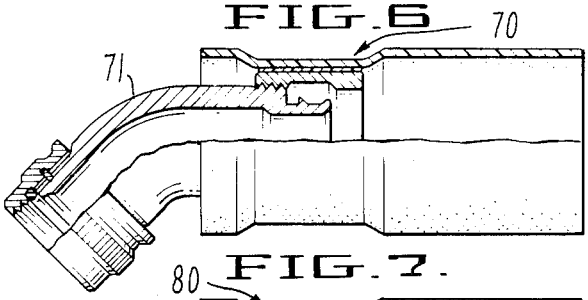
Figure 8:
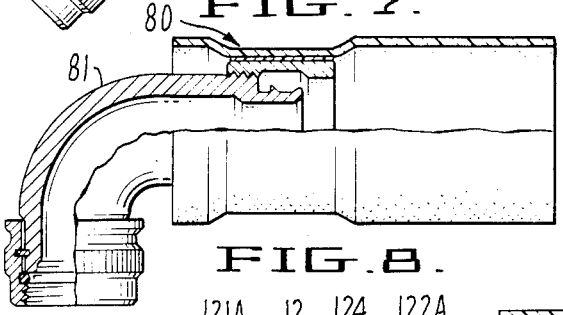

In FIGS. 7 and 8 the backshell assemblies 70 and 80, respectively, include body members 71 and 81 which include bends of 45' and 90', respectively. The backshell can include other typical angles such as 30' and 60'.

Figure 9:
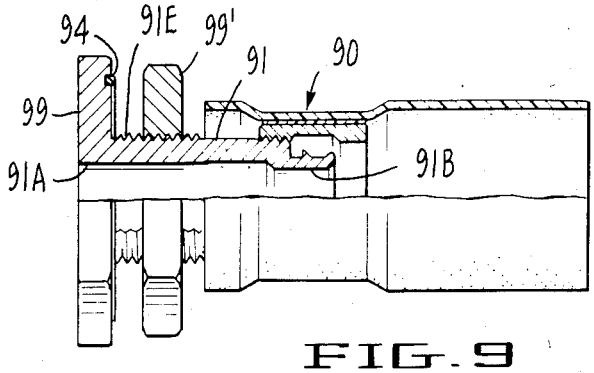

FIG. 9 illustrates a panel or bulkhead rear mounting assembly structure 90. As shown, the backshell or adapter body member 91 includes an outwardly projecting retaining flange 99 on the first end 91A thereof. In use the second end 91B of the body 91 is first passed through an aperture in a panel or bulkhead and a jam nut 99' is threaded onto threads 91E on the body 91 to attach the body 91 to the panel which is the other electrical device in this embodiment. An "O" ring 94 is provided on the flange 99 to make the seal between the body 91 and the backside of the panel from the assembly 90.

Figure 10:
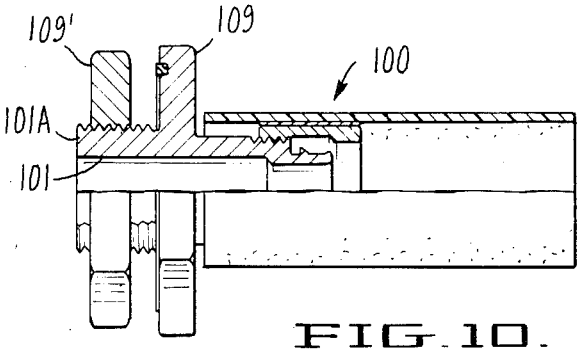

In the alternative bulkhead front mounting assembly 100 illustrated in FIG. 10 an outwardly projecting flange 109 is provided midway along the length of the body 101 and a jam nut 109' threads onto the first end 101A of the body 101 for clamping the assembly 100 to a panel or bulkhead.

Figure 11:
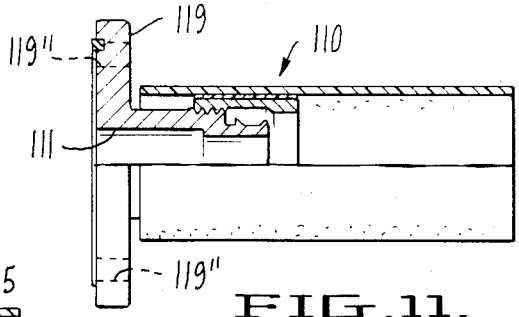

In the front flange mounting assembly 110 shown in FIG. 11 an outwardly projecting flange 119 is provided on the first end of the body member 111. The flange 119 is provided with mounting holes 119'' for attaching the assembly 110 to a panel or bulkhead, such as by screws (not shown).

While the backshell assembly 10 of the preferred embodiment includes the two members 11 and 12 which are screwed together and which are metallic for achieving the necessary grounding connection with the cable, members of constructions other than those illustrated by body 11 and nut 12 of FIGS. 1–4 and alternative structures of FIGS. 5–11 can be utilized within the scope of the present invention. Therefore, the terms "body" and "nut" are used herein to mean hollow cylindrical members for passing conductors of a cable and generally for attachment to the cable and to another electrical device.

Referring now to FIGS. 12A–12D, there is illustrated the method of manufacturing the backshell assembly 10 and principally the nut 12 bonded to the heat shrinkable tubing 15. A pair of low friction mandrels 121 and 122, such as Teflon or Teflon coated mandrels, are provided having a diameter of the ultimate diameter desired for the interior surface of the tube end extensions 15A and 15B, each mandrel having a bevelled end, 121A and 122A respectively, to provide the smooth transition from the larger diameter extensions 15A and 15B to the diameter of the outside surface of the nut 15. The mandrels 121 and 122 have axial bores for receiving a spindle 123, and an annular centering insert 124 is provided having a central bore for sliding on the spindle 123 and an outside cylindrical surface that slides closely within the nut 12. A tubing stop 121C is provided on the external surface of mandrel 121 at the desired longitudinal distance along the mandrel 121 for the end of the extension 15A on the resulting tube 15.

Figure 12A:
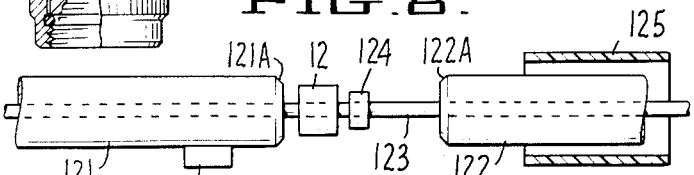
FIGS. 12A–12D are elevational views, partially in section, illustrating the preferred method of making the backshell assembly in accordance with the present invention.
Figure 12B:
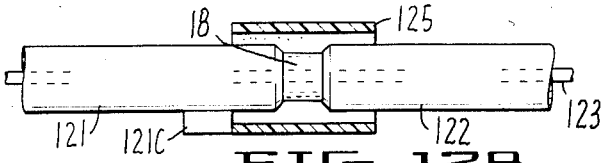
Figure 12C:
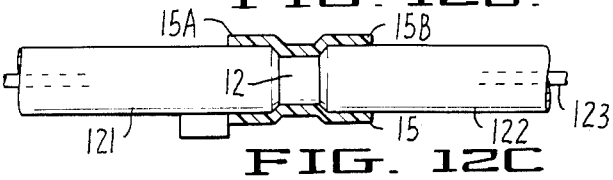
Figure 12D:
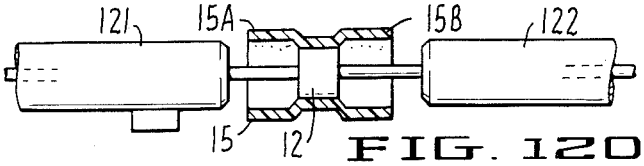

With the mandrel 121 and centering insert 124 positioned on the spindle 123, the nut 12 is placed over the insert 124 and the other mandrel 122 slipped in place on the spindle so that the nut 12 is clamped between the beveled mandrel ends 121A and 122A. The bonding adhesive 18 is applied to the outside surface of the nut 12. Next, a piece of heat shrinkable tubing or boot 125 of the desired length is slipped over the entire assembly up to the tubing stop 121C on mandrel 121 as shown in FIG. 12B. Heat is then applied to the tubing 125 beginning at the end next to tube stop 121C until the ends of the tubing 125 have shrunk down onto the mandrels 121 and 122 and the medium or central portion of the tubing 125 has shrunk down onto the nut 12 and is bonded thereto as shown in FIG. 12C. The mandrel assembly with the nut and shrunk tubing is then cooled such as by being placed in cold water and the mandrels removed. The sealant 16 is then coated on the interior surfaces of the extensions 15A and 15B.

When the tubing 26 is shrunk down onto the mandrels 121 and 122, longitudinal stresses in the tubing 125 are alleviated so that precise positioning of the end extensions 15A and 15B can be achieved when the tube is shrunk in the final application down onto the cable and backshell body. The precise position of the end of the tube extension 15A is important because in the preferred embodiment of FIGS. 1–4 the tube extension 15A shrinks down onto the spin coupling 13 and keeps the spin coupling from rotating.

Figure 13:
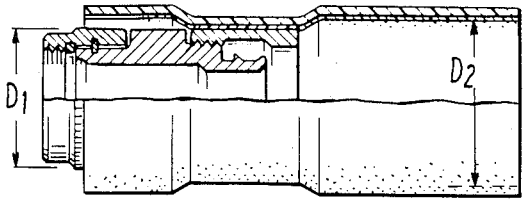
FIG. 13 is a view illustrating important dimensional aspects of the backshell assembly in accordance with the present invention.

FIG. 13 illustrates the preferred relationship of the diameter of the tube extensions 15A and 15B relative to the outside diameter of the body 11 for achieving softening of the sealant 16 before the tubing 15 shrinks onto the cable and the body 11. It has been found that the preferred relationship is such that the inside diameter of the tube extensions is at least 1.08 times the outside diameter of the body.

The terms and expressions which have been employed here are used as terms of description and not of limitations, and there is no intention, in the use of such terms and expressions, of excluding equivalents of the features shown and described, or portions thereof, it being recognized that various modifications are possible within the scope of the invention claimed.

We claim:

1. A backshell assembly for connecting an electrical cable to other electrical devices comprising, in combination:

a hollow cylindrical body member having a first end for attachment to the other electrical device and a second end;

a hollow cylindrical nut having an outside surface, a first end for attachment to said second end of said body member and a second end; and a hollow cylindrical, heat shrinkable tube surrounding said nut and extending axially beyond both said first and said second ends of said nut, the interior surface of said tube being bonded to said outside surface of said nut before the nut is assembled to said body member and before the axial extensions are shrunk onto the body member and the electrical cable whereby said body member and said nut can be attached together and to the cable and the other device and the extensions of said tube shrunk down onto said body member and the cable.

2. A backshell assembly for connecting an electrical cable to other electrical devices comprising, in combination:

a hollow cylindrical body member having a first end for attachment to the other electrical device and a second end;

a hollow cylindrical nut having an outside surface, a first end for attachment to said second end of said body member and a second end; and a hollow cylindrical, heat shrinkable tube surrounding said nut and extending axially beyond both said first and said second ends of said nut, the interior surface of said tube being bonded to said outside surface of said nut, the axial extensions of said tube beyond said first and second ends of said nut have a layer of sealant on the inside surface thereof and have an inside diameter greater than the diameter of said outside surface of said nut whereby said body member and said nut can be attached together and to the cable and the other device and the extensions of said tube shrunk down onto said body member and the cable.

3. The backshell assembly of claim 2 wherein said inside diameter of said tube first end is at least 1.08 times the outside diameter of said body member.

4. The backshell assembly of claim 2 wherein said extensions of said tube have been stress relieved by being heat shrunk to said diameter greater than the diameter of said outside surface of said nut.

5. The backshell assembly of claim 1 wherein said tube is formed from tubing having a shrink ratio of at least about 3 to 1.

6. The backshell assembly of claim 1 wherein the outside surface of said body member has a diameter the same as or less than the diameter of said outside surface of said nut.

7. The backshell assembly of claim 6 wherein said body member includes at said first end thereof a spin coupling member.

8. The backshell assembly of claim 7 wherein the extension of said tube beyond said first end of said nut extends axially over at least a portion of said spin coupling member.

9. The backshell assembly of claim 1 wherein said body member and said nut are metallic for grounding a metal shield of the electrical cable.

10. A backshell assembly for connecting an electrical cable to other electrical devices comprising, in combination:

a hollow cylindrical body member having a first end for attachment to the other electrical device and a second end;

a hollow cylindrical nut having an outside surface, a first end for attachment to said second end of said body member and a second end, the diameter of said nut outside surface being at least as great as the outside diameter of said body member; and a hollow cylindrical, heat shrinkable tube surrounding said nut and extending axially beyond both said first and said second ends of said nut, the interior surface of said tube being bonded to said outside surface of said nut, the axial extensions of said tube being stress relieved by being heat shrunk, said extensions having an inside diameter greater than the diameter of said outside surface of said nut, whereby said body member and said nut can be attached together and to the cable and the other device and the extensions of said tube shrunk down onto said body member and the cable.

11. The backshell assembly of claim 10 wherein said axial extensions of said tube beyond said first and second ends of said nut have a layer of sealant on the inside surface thereof.

12. The method of forming a backshell assembly comprising the steps:

forming a nut for passing an electrical cable therethrough;

heat shrinking a tube so that the medium portion of the tube is shrunk onto the outside surface of the nut with portions of the tube extending beyond both ends of the nut;

bonding the medium portion of the tube to the outside surface of the nut before the nut is assembled to a body member and before the portions of the tube extending beyond both ends of the nut are shrunk onto a body member or an electrical cable; and forming a backshell body member for passing the electrical cable therethrough and for attachment to said nut and to the electrical cable whereby said body member and said nut can be attached together and to the cable and the other device and the extension of said tube shrunk down onto said body member and the cable.

13. The method of forming a backshell assembly comprising the steps:

forming a nut for passing an electrical cable therethrough;

forming a backshell body member for passing the electrical cable therethrough said for attachment to said nut and to the electrical cable;

heat shrinking a tube so that the medium portion of the tube is shrunk onto the outside surface of the nut and the portions of the tube extending beyond both ends of the nut are shrunk to a diameter greater than the diameter of the outside surface of said nut; and bonding the medium portion of the tube to the outside surface of the nut before the nut is assembled to the body member and before the tube extensions have been shrunk down onto the body member or an electrical cable whereby said body member and said nut can be attached together and to the cable and the other device and the extensions of said tube shrunk down onto said body member and the cable.

14. The method of claim 13 wherein said shrinking step includes maintaining the diameter of the extensions of the tube at least 1.08 times the diameter of the outside surface of the body member.

15. The method of forming a mechanical and electrical connection between an electrical cable and another electrical device comprising the steps of:

forming a nut for passing an electrical cable therethrough;

heat shrinking a tube so that the medium portion of the tube is shrunk onto the outside surface of the nut and the portions of the tube extending beyond both ends of the nut are shrunk to a diameter greater than the diameter of the outside surface of the nut;

bonding the medium portion of the tube to the outside surface of the nut before the nut is assembled to a body member or a cable;

forming a backshell body member for passing the electrical cable therethrough and for attachment to said nut and to the electrical cable;

attaching the nut and the body member together and to the cable; and shrinking the ends of the tube onto the body member and onto the cable.

16. The method of claim 15 wherein the step of shrinking the ends of the tube onto the body member and the cable includes capturing the cable and the body member together with the extensions of the tube beyond the ends of the nut shrunk down to a diameter less than the outside diameter of the nut.

* * * * *